US007140063B2

(12) United States Patent
Osborne

(10) Patent No.: US 7,140,063 B2
(45) Date of Patent: Nov. 28, 2006

(54) MULTI-USE AND DECORATIVE BATHING IMPLEMENT

(76) Inventor: James J. Osborne, 704 Abbeydale Ct., Ambler, PA (US) 19002

( * ) Notice: Subject to any disclaimer, the term of this patent is extended or adjusted under 35 U.S.C. 154(b) by 364 days.

(21) Appl. No.: 10/275,050

(22) PCT Filed: May 2, 2001

(86) PCT No.: PCT/US01/14117

§ 371 (c)(1),
(2), (4) Date: Oct. 31, 2002

(87) PCT Pub. No.: WO01/85002

PCT Pub. Date: Nov. 15, 2001

(65) Prior Publication Data

US 2003/0208871 A1 Nov. 13, 2003

Related U.S. Application Data

(60) Provisional application No. 60/201,944, filed on May 5, 2000.

(51) Int. Cl.
*A47K 7/02* (2006.01)

(52) U.S. Cl. ..... 15/209.1; 15/229.11; 15/244.1; 15/244.4; 401/131; 401/201; 248/205.5; 248/206.2; 248/309.3; 248/363; 248/915

(58) Field of Classification Search ..... 15/118, 15/209.1, 229.11, 244.1, 244.4; 248/205.5, 248/206.2, 309.3, 346.2, 363, 683, 915; 401/131, 401/201
See application file for complete search history.

(56) References Cited

U.S. PATENT DOCUMENTS

| | | | |
|---|---|---|---|
| 1,280,541 | A | 10/1918 | Potthoff |
| 1,397,611 | A | 2/1921 | Bailey |
| 1,794,854 | A | 3/1931 | Kean |

(Continued)

FOREIGN PATENT DOCUMENTS

| | | | |
|---|---|---|---|
| CN | 2271120 | Y | 12/1997 |

(Continued)

*Primary Examiner*—Mark Spisich
(74) *Attorney, Agent, or Firm*—Howson & Howson

(57) ABSTRACT

A multi-use bathing implement (10, 10a, 10b, 10c, 58) for use in cleansing and exfoliating skin and as a toy, a holder of soap or like products, and a decoration. The bathing implement (10, 10a, 10b, 10c, 58) includes a toroidal sponge component (14) and can also have a removable attachment component (26, 30). The donut-shaped sponge component (14) is preferably made of mesh sponge material and is concentrically disposed about an inner ring-shaped component (16, 16a, 16c, 64) defining a central opening (12, 62) in which the attachment component (26, 30) can be removably secured. The inner ring-shaped component (16, 16a, 16c, 64) provides a ready gripping area which can be held for manipulating the bathing implement (10, 10a, 10b, 10c, 58). The attachment component (26, 30) can be, for instance, a toy, a solid soap product, a container of a bath/cosmetic product or the like, a mesh netting pocket, or a knob-shaped hanging device (44, 46, 48, 50, 52, 54, 56) having a suction cup (66). In addition, the implement (10) can have a drawstring (24) for converting the toroid shape sponge into a ball shaped sponge.

14 Claims, 13 Drawing Sheets

U.S. PATENT DOCUMENTS

| | | | | |
|---|---|---|---|---|
| 1,835,294 | A | 12/1931 | Gilham | |
| 2,139,805 | A | 12/1938 | Chase | |
| 2,177,504 | A | 10/1939 | Thompson | |
| 2,278,075 | A | 3/1942 | Hecht | |
| 2,813,291 | A | 11/1957 | Wark | |
| 3,660,861 | A | 5/1972 | Delmonico | |
| 4,199,835 | A | 4/1980 | Heyer et al. | |
| D292,030 | S | 9/1987 | Revson | D28/41 |
| 5,144,744 | A | 9/1992 | Campagnoli | 29/446 |
| 5,156,171 | A | 10/1992 | Goodman | 132/200 |
| 5,301,696 | A | 4/1994 | Revson | 132/273 |
| 5,413,126 | A | 5/1995 | Revson | 132/275 |
| 5,465,452 | A | 11/1995 | Girardot et al. | 15/210.1 |
| 5,502,863 | A | 4/1996 | Perkins | 15/227 |
| 5,650,384 | A | 7/1997 | Gordon et al. | 510/159 |
| 5,713,094 | A | 2/1998 | Markey et al. | 15/229.11 |
| 5,727,277 | A | 3/1998 | Chien | 15/209.1 |
| 5,727,278 | A | 3/1998 | Per-Lee | 15/229.11 |
| 5,766,700 | A | 6/1998 | Borcherds | 428/5 |
| D396,907 | S | 8/1998 | Donnelly | D32/43 |
| 5,787,542 | A | 8/1998 | Chien | 15/244.3 |
| D405,925 | S | 2/1999 | Badillo | D28/63 |
| 5,944,032 | A | 8/1999 | Masterson | 132/290 |
| 5,983,435 | A | 11/1999 | Osborne | 15/209.1 |
| 6,032,319 | A | 3/2000 | Garello | 15/229.11 |
| 6,053,464 | A | 4/2000 | Cardarelli | 248/205.8 |
| 6,161,246 | A | 12/2000 | Trachtenberg | 15/229.13 |

FOREIGN PATENT DOCUMENTS

| | | |
|---|---|---|
| DE | 1 002 926 | 2/1957 |
| EP | 0 819 392 A1 | 1/1998 |

MULTI-USE AND DECORATIVE BATHING IMPLEMENT

CROSS REFERENCE TO RELATED APPLICATIONS

This application is a 371 of PCT/US01/14117 which was filed on May 2, 2001 and which claims the benefit of priority of U.S. Provisional Patent Application No. 60/201,944 filed on May 5, 2000.

FIELD OF THE INVENTION

The present invention relates to a multi-use implement useful, for instance, as a cleaning implement, toy, marketing product or decoration, and more particularly, the present invention relates to a decorative bathing implement capable of use with soap during a bath or shower to cleanse and exfoliate skin.

BACKGROUND OF THE INVENTION

Most people utilize their hands, or a washcloth, to lather soap and apply the lathered soap to the body during bathing. More recently, sponges, netting material or mesh material have been utilized as washcloths since they also provide an exfoliation function. The mesh sponges are provided in a substantially ball-like shape and include a thin, elongate nylon string which enables the sponges to be hung until further use. Examples of such sponges are provided by U.S. Pat. No. 5,650,384 issued to Gordon et al.; U.S. Pat. No. 5,727,278 issued to Per-Lee; U.S. Pat. No. 6,032,319 issued to Garello; and U.S. Pat. No. 5,144,744 issued to Campagnoli.

The typical ball-shaped mesh sponge is limited to use as solely a bathing implement and does not permit ready attachment of removable objects to the sponge. Such objects might include a bar of soap or a water friendly bath toy. The purpose of the attachment could be to convert the bathing implement into a bath toy or an out-of-bath toy, to provide a pleasing bathing-area decoration or store display, or to enable ready application of soap to a bather.

Another problem relative to children, particularly young children, is that they often dislike bathing. In addition, young children often do not apply, or find it difficult to apply, a sufficient amount of lathered soap on their own to their bodies. At least a partial solution to this problem is the use of bath toys which help make a bath more enjoyable for the child.

U.S. Pat. No. 5,983,435 issued to Osborne addresses the above problem by providing a combination bathing implement and bath toy. To this end, the bathing implement can be readily grasped by the hand of a young child, can be used to cleanse and exfoliate skin, can be utilized as a bath toy, and provides an aesthetically pleasing bathing-area decoration. Another example of a bathing implement particularly intended for use by a child is provided by U.S. Des. Pat. No. 405,925 issued to Badillo.

Other body washing implements intended for use by adults are disclosed in U.S. Pat. Nos. 5,727,277 and 5,787,542 issued to Chien; U.S. Pat. No. 5,944,032 issued to Masterson; U.S. Pat. No. 5,465,452 issued to Girardot et al.; U.S. Pat. No. 5,713,094 issued to Markey et al.; and U.S. Pat. No. 1,397,611 issued to Bailey. The Chien '277 and Markey patents disclose body washing implements having a handle. The Chien '542 and Bailey patents disclose body washing implements which are adapted to readily hold a bar of soap. The Masterson patent discloses the use of a squeezable bladder which contains liquid soap and which can be attached to a ball-shaped bathing implement. The Girardot patent discloses a toroidal, or donut-shaped, bathing implement which does not have a dense center core.

Although the above referenced bathing implements may be satisfactory for their intended purposes, there is a need for an improved and novel bathing implement that has multi uses other than as a bathing implement, that is intended for use by both children and adults, and that provides a decorative appearance both in the home of the consumer and in a display in the marketplace. The unique implement should enable attachments, such as toys, soap, containers, etc., to be readily secured to the implement, readily removed from the implement, and readily replaced back into the implement.

OBJECTS OF THE INVENTION

With the foregoing in mind, a primary object of the present invention is to provide a multi-use bathing implement which can be used by both children and adults in a practical manner to cleanse and exfoliate skin.

Another object of the present invention is to provide a multi-use bathing implement which can be readily and effectively used by children and adults, which can be easily grasped and controlled by the hand of a young child as well as the hand of an adult, and which is readily stored and dried.

A further object of the present invention is to provide a multi-use bathing implement which provides an aesthetically pleasing appearance in a display in a store where purchased and in the home of the ultimate consumer.

A still further object of the present invention is to provide a bathing implement with a removable attachment device which converts the bathing implement into a multi-use implement. For example, the attachment device can be a toy, a standard bar of soap, a specially molded soap-like product, a container of liquid soap, shampoo, hand lotion or like product, or a material of netting or the like which provides a pocket area for toys, soap products or the like.

A still further object of the present invention is to provide a bathing implement which provides an aesthetically pleasing bathing-area decoration so that an inviting atmosphere is created. The decoration could be appropriate for a child or an adult depending on the form and shape of the bathing implement and the attachment device.

A still further object of the present invention is to provide an implement which can be utilized for a variety of purposes, for example, as a bathing implement, a cleaning implement, a so called "scrunchi" implement which can be worn in a person's hair, a bracelet or headband implement that can be worn on a person's wrist or head, a toy implement, a holding implement which includes an attached container or mesh netting pocket filled with toys, body wash, spritz, soap, stockings, or other consumer products.

SUMMARY OF THE INVENTION

More specifically, the present invention provides a bathing implement which includes a toroidal (ie. donut-shaped) sponge component useful during a bath or shower to apply lather and/or exfoliate the skin of the bather. Preferably, the bathing implement includes an inner ring-shaped component, and the sponge component is integrally attached to, and extends radially outward from, an outer periphery of the inner ring-shaped component to provide the sponge component with the stated toroid shape. The inner ring-shaped component is preferably made of an inner elastic loop-shaped band which is entirely covered by an outer material of, for instance, terry cloth, taffeta, or any like material including materials which tend to dry quickly.

Preferably, the bathing implement includes an attachment component, such as, a separate toy, soap, container or other attachable object. The inner ring-shaped component is appropriately sized such that it can be secured about a medial portion of the attachment component to enable the attachment component to be removed from, and reattached to, the sponge component. If the attachment component is a toy, it is preferably "water-friendly" and can dry in a relatively quick period of time. Furthermore, when the toy, soap, container or other attachment component is removed, an adult or child can insert their hand, or a desire portion of their hand, through the inner ring-shaped component to grip the bathing implement in a manner which permits ready control and manipulation of the sponge component. The toroidal bathing implement can also be temporarily worn around a bather's wrist to free the hands of the bather during a shower or bath. The implement can also be worn outside the bathing-area in a person's hair as a scrunchi, around a person's wrist as a wristband, or around a person's head as a headband.

The multi-use toroidal bathing implement also provides a decoration for a store display or a consumer's bathing area. For instance, a disk-shaped attachment component can be secured within the inner ring-shaped component to provided the appearance of a flower. The disk-shaped attachment component can be a soap product and the soap product and bathing implement can be provided in pleasing colors and have pleasing patterns and designs thereon.

According to another aspect of the present invention, preferably, a cord extends from the bathing implement to provide a means of hanging the implement. More preferably, the cord is looped through the inner ring-shaped component and can be utilized as a draw-string to convert the toroid shape of the sponge component into a substantially ball-shaped sponge. To this end, the bathing implement is urged radially inward by pulling the draw-string and compressing the inner ring-shaped component. Thereafter, the sponge component can be permitted to expand radially outward to return the bathing implement to its normal toroid shape.

According to yet another aspect of the present invention, a suction cup attachment device is utilized in combination with the cleaning implement to provide a means of hanging the cleaning implement when not in use. To this end, the attachment device includes a suction cup for removably securing the device to a shower wall or like bathroom/kitchen surface. In addition, the device includes a forward extending hanger on which a cleaning implement can be connected. Preferably, the hanger extends through the open center of the cleaning implement and is snugly engaged by the inner loop of the cleaning device. Further, preferably the front of the hanger provides a decoration, toy, clock, soap dispenser, or like useful device.

BRIEF DESCRIPTION OF THE DRAWINGS

The foregoing and other objects, features and advantages of the present invention should become apparent from the following description when taken in conjunction with the accompanying drawings, in which.

DETAILED DESCRIPTION OF THE PREFERRED EMBODIMENT

FIGS. 1–5 illustrate the basic embodiment of a multi-use bathing implement 10 according to the present invention. As illustrated, the bathing implement 10 is toroidal (ie. donut shaped) and has an open central portion 12. Preferably, the bathing implement 10 includes a sponge component 14 extending radially outward from an inner peripheral component 16 which defines the open central portion 12 of the bathing implement 10. The inner component 16 can have elastic or non-elastic properties. As illustrated, the inner component 16 is preferably ring-shaped to provide a circular open central portion 12. However, the inner component 16 could be provided in other shapes, such as, multi-sided shapes, which can provide a square, star-shaped or other-shaped open central portion. In addition, if the inner component 16 is elastic, the inner component 16 can stretch to provide the open central portion 12 with any desired shape.

Figure 16:
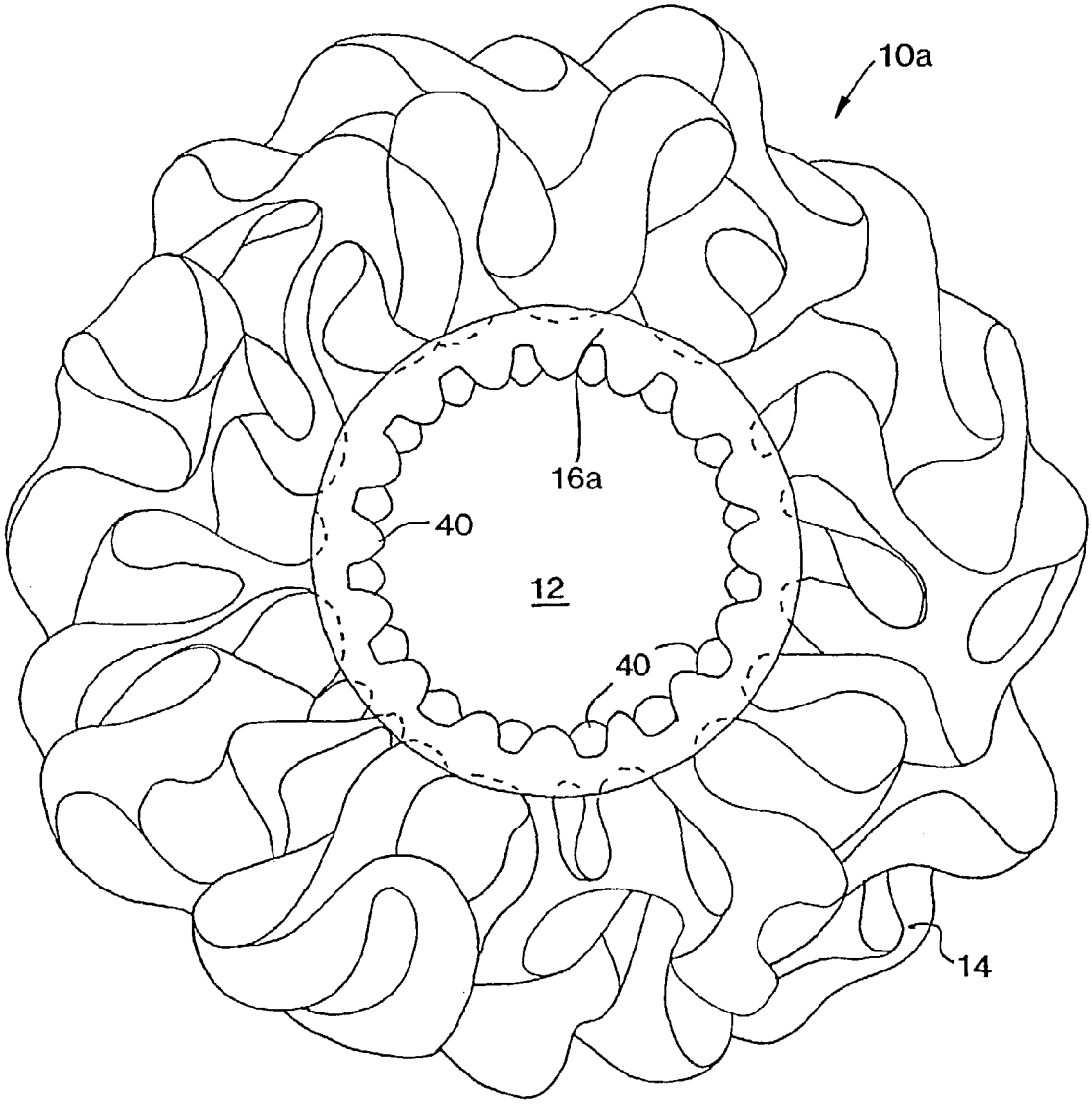
FIGS. 16 and 17 are perspective views of second and third alternate embodiments of bathing implements according to the present invention.
Figure 17:
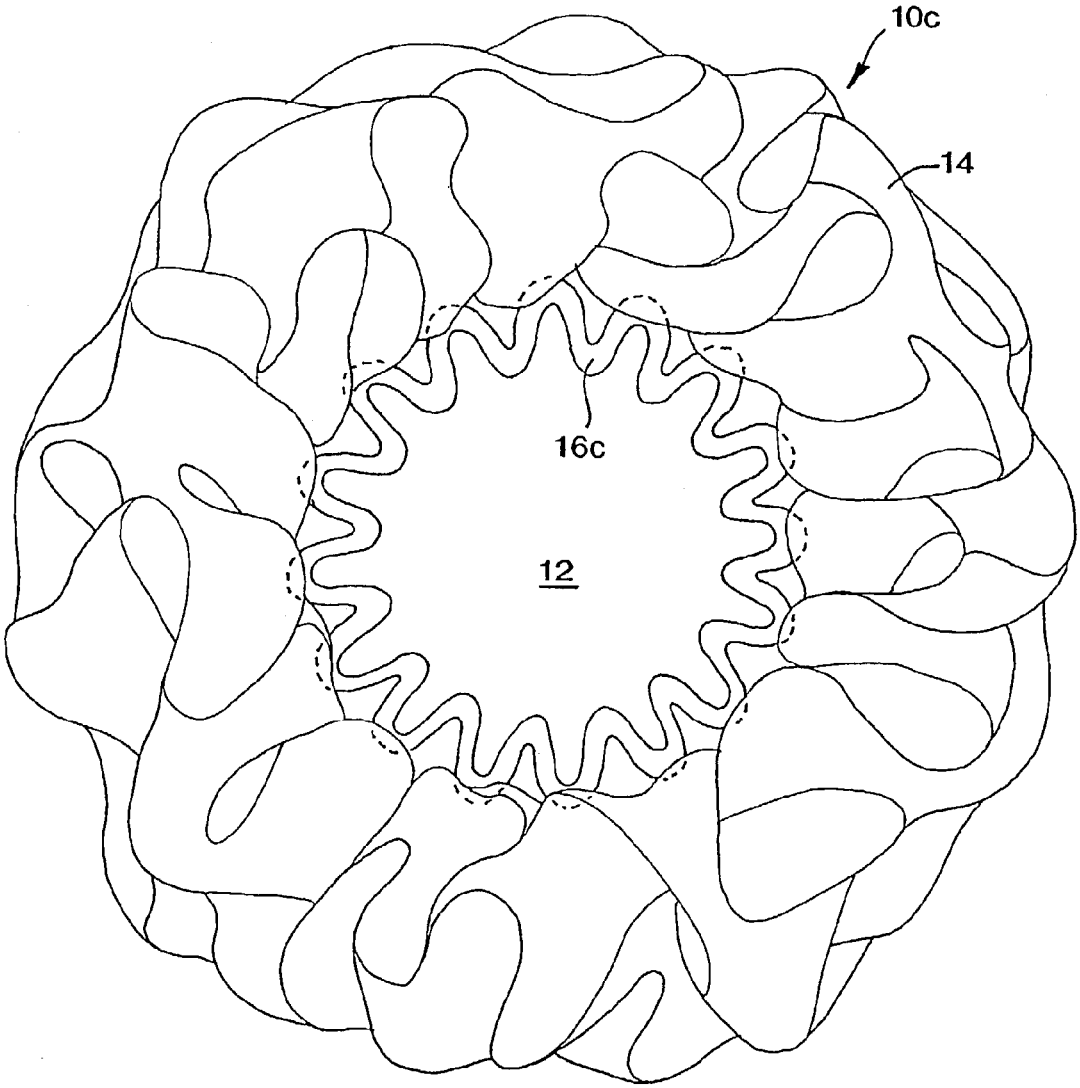
Figure 18:
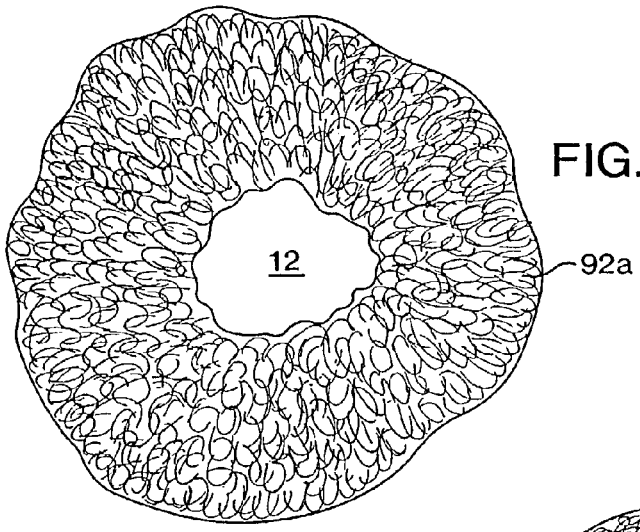
FIGS. 18–21 are front elevational views of various kitchen cleaning implements according to the present invention.
Figure 19:
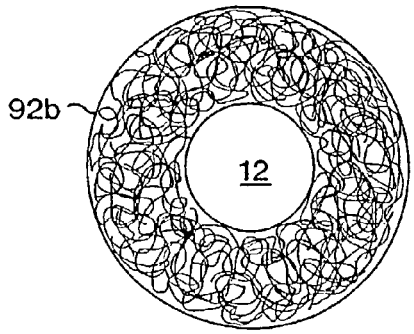
Figure 20:
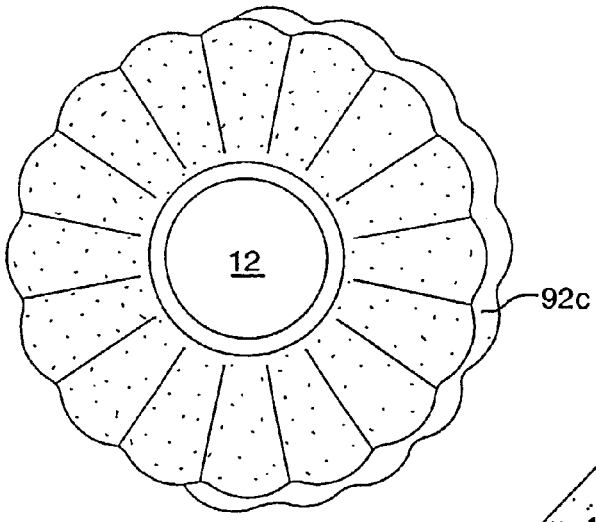
Figure 21:
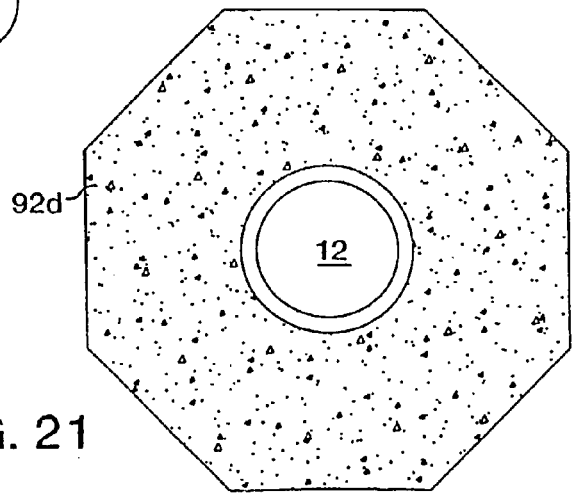

The inner component 16 is preferably made from a loop-shaped elastic band 18, such as a rubber band or other elastic product, which is covered by an outer material 20. The outer material 20 can be stitched to the band 18 and can be any type of material. Examples of useful materials include mesh, netting, taffeta, terry cloth, cotton, materials that dry quickly, materials that are stretchable, materials that are not stretchable, and materials that bunch up when in a non-stretched condition. Preferably, when a taffeta, terry cloth or like material is utilized, it is provided with a plurality of venting apertures which permit ready drying of the material and band. Thus, the construction of the inner component 16 permits the bathing implement 10 to have a defined open central portion 12 and preferably, to be capable of stretching to expand the open central portion 12. In addition, preferably the inner component 16 is resilient and returns to its original shape when in a non-stretched condition. However, the inner component can also be made of other materials such as illustrated in FIGS. 16 and 17 in which bathing implements 10*a* and 10*c* have molded inner components 16*a* and 16*c*, respectively, made of a plastic and/or rubber-like material. Inner component 16*a* is molded with integral inwardly extending massaging nubs 40, while inner component 16*c* has an undulating shape. Inner component 16*a* and 16*c* can be attached to the sponge component 14 by heating the inner component thereby welding the sponge component thereto. Another alternative is to provide an inner component made of soap.

Figure 7:
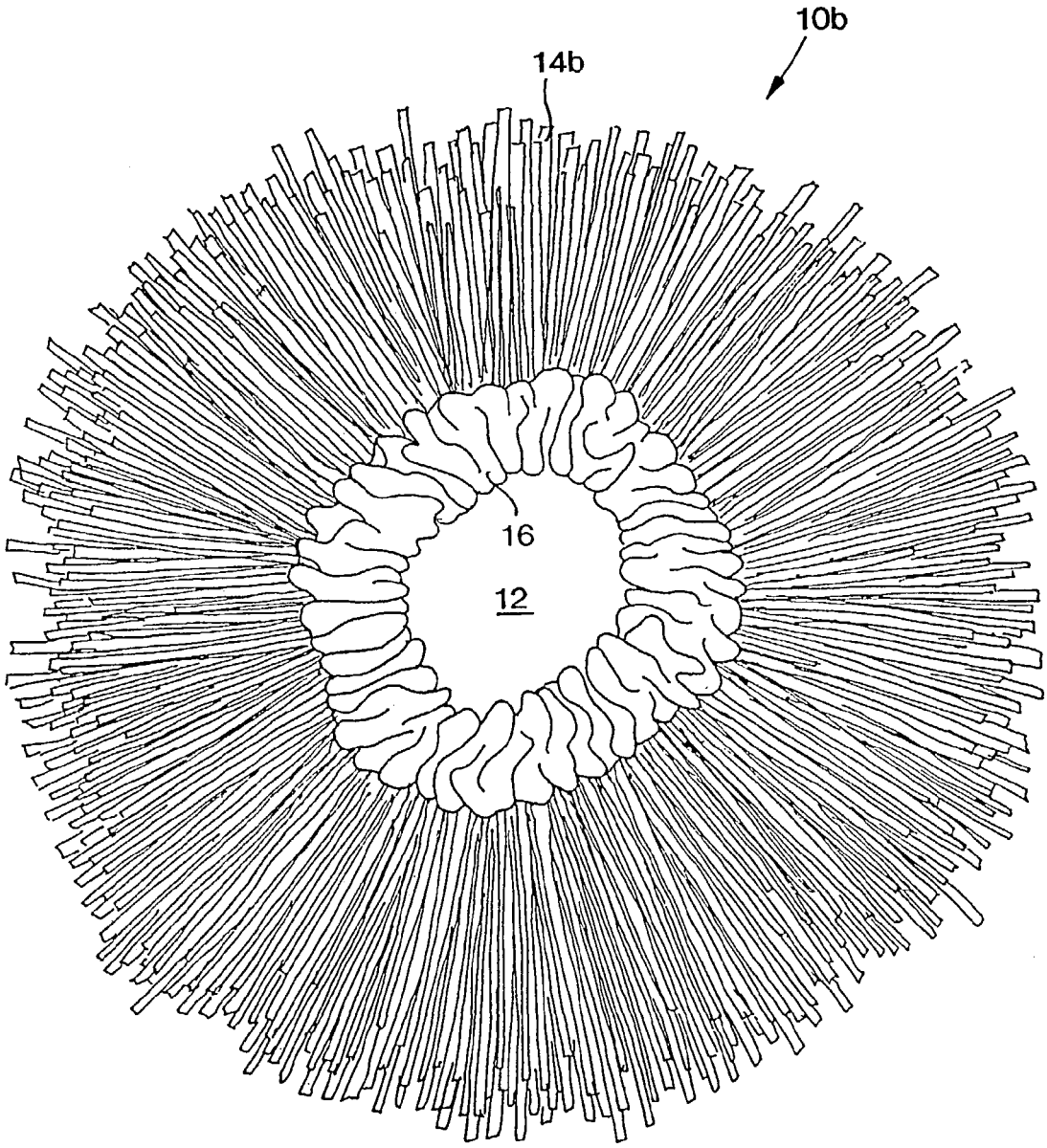
FIG. 7 is a perspective view of alternate embodiment of bathing implement according to the present invention.

The sponge component 14 is integrally stitched to the outer peripheral surface 22 of the inner ring-shaped component 16 and extends radially outward therefrom. In the preferred embodiment, the sponge component 14 and outer material 20 are stitched to the elastic band 18 simultaneously with the same thread. The sponge component 14 is preferably a material that can be used to apply lather to a bather and/or exfoliate the skin of the bather. Examples include various types and shapes of sponges, mesh, netting, terry cloth, PVA, cotton or like washcloth materials. Preferably, as illustrated, the sponge component is made of a flexible mesh netting material commonly utilized in known ball-shaped bathing implements. Alternatively, the outer component 14 could be made of other materials, for example, see the bathing implement/flying toy 10*b* which is illustrated in FIG. 7 and which has elastomeric fibers 14*b* as an outer component.

Figure 1:
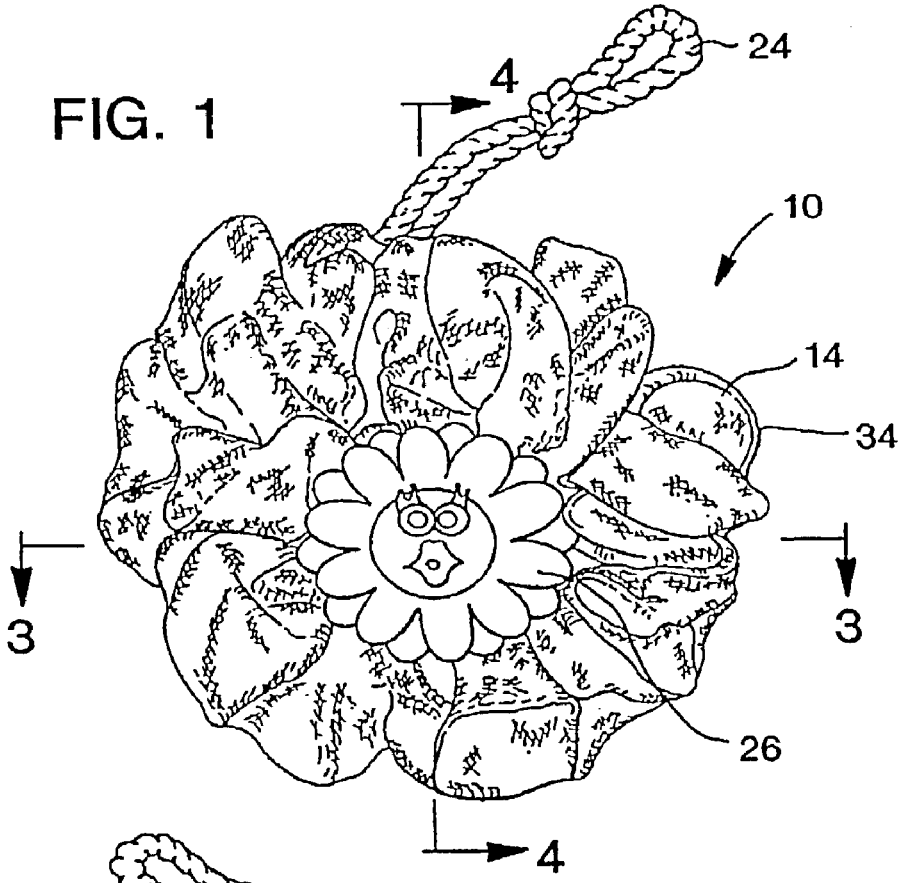
FIG. 1 is a perspective view of a toroidal bathing implement with an attachment component according to the present invention.
Figure 2:
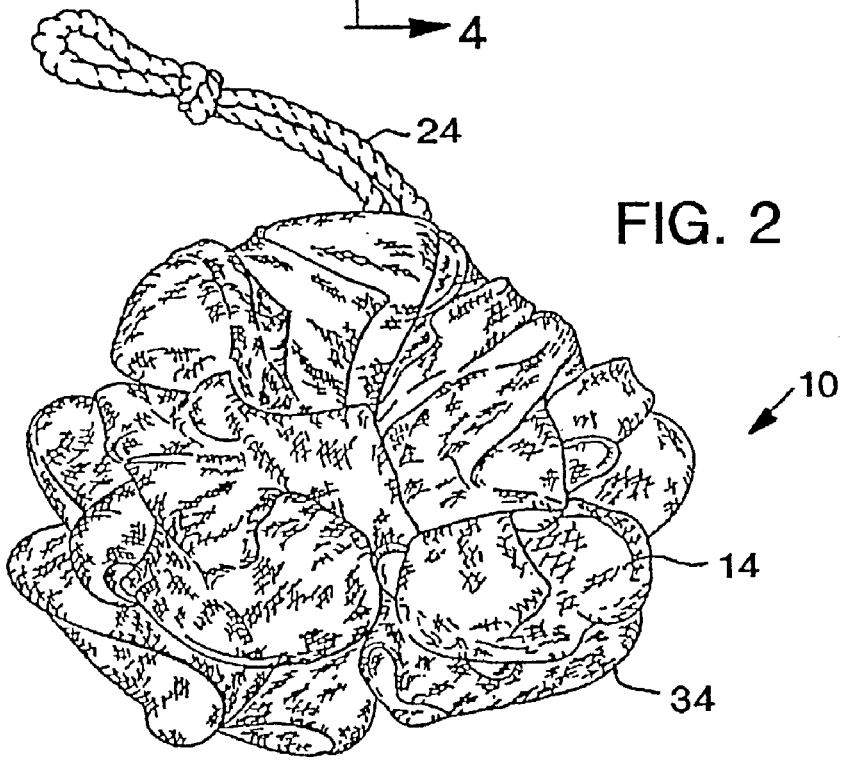
FIG 2 is a perspective view of the bathing implement illustrated in FIG. 1 after it has been compressed by a drawstring into a ball shape.
Figure 3:
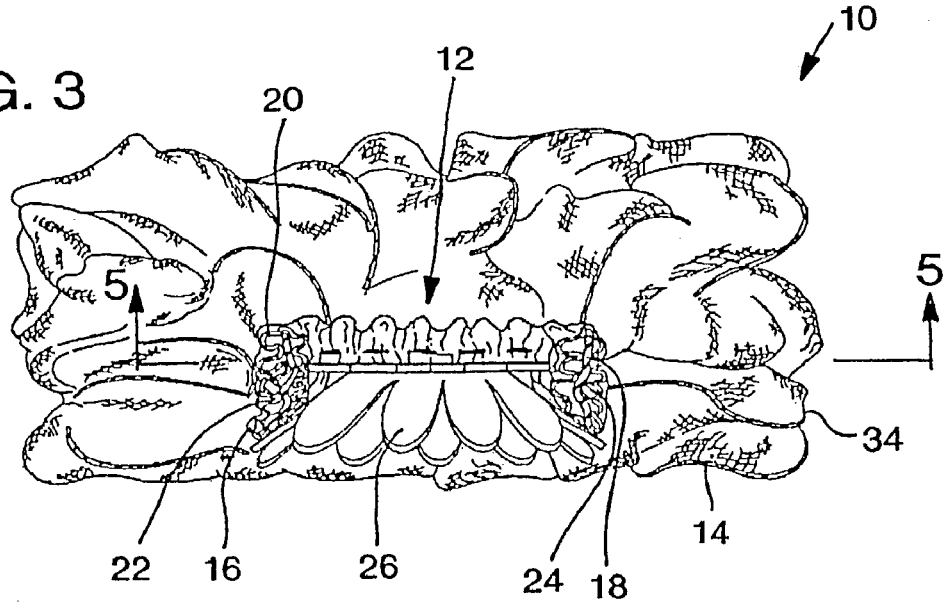
FIG. 3 is a cross-sectional view of the bathing implement illustrated in FIG. 1 along line 3—3 of FIG. 1.
Figure 4:
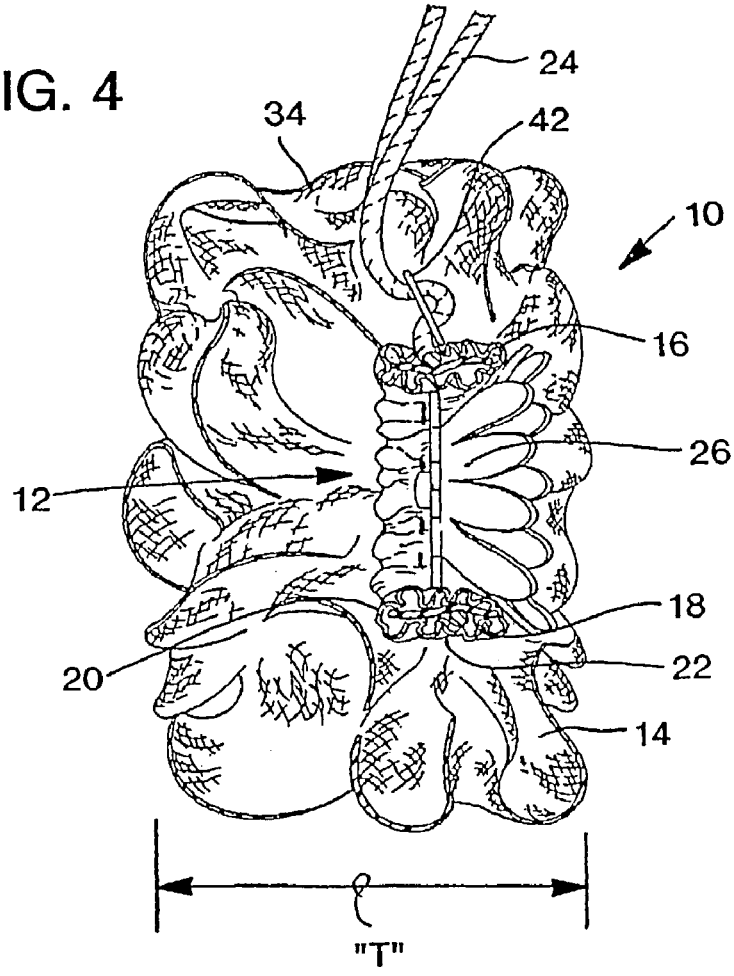
FIG. 4 is a cross-sectional view of the bathing implement illustrated in FIG. 1 along line 4—4 of FIG. 1.
Figure 5:
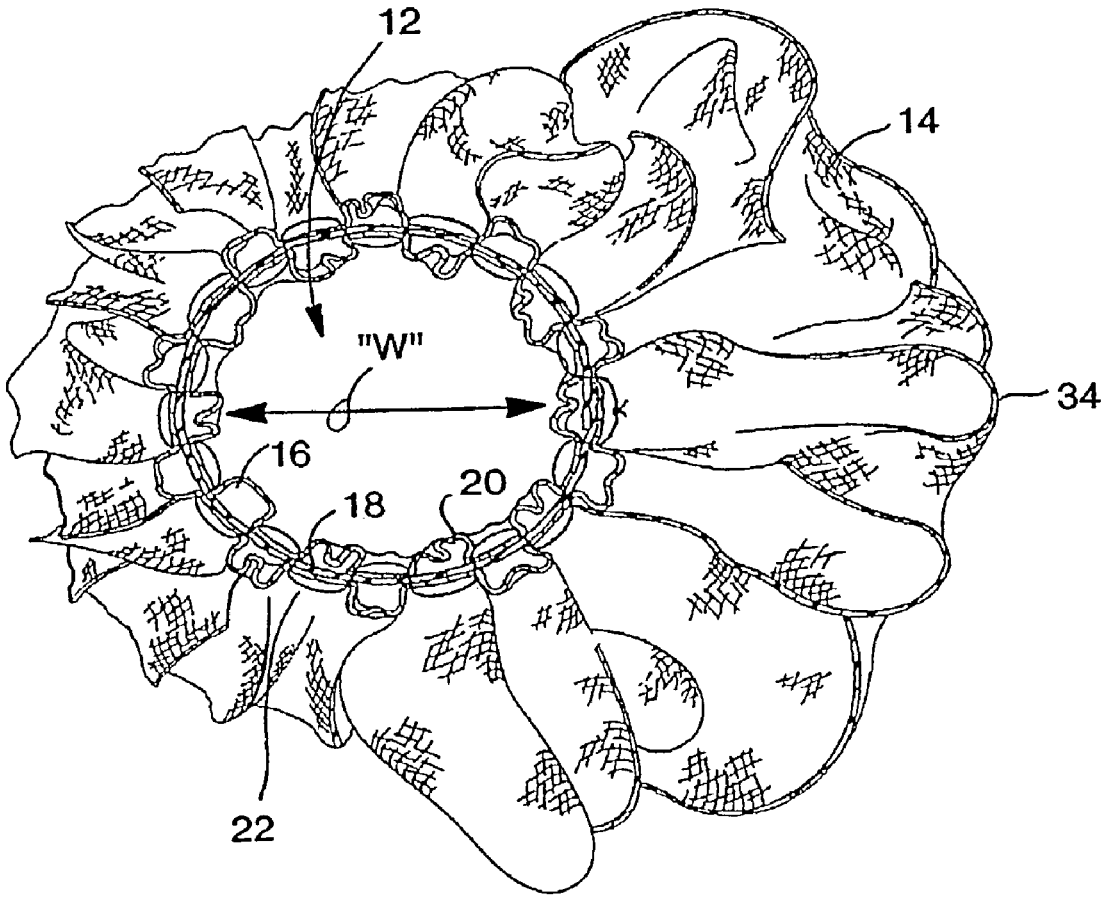
FIG. 5 is a cross-sectional view of the bathing implement illustrated in FIG. 1 along line 5—5 of FIG. 3.

The bathing implement 10 can include a cord, string, elastic band or a combination of a cord and a band or the like, 24 which extends from the bathing implement 10 and can be used to hang the bathing implement for drying purposes. In one contemplated embodiment, the cord 24 is provided as a loop, a part of which extends through the inner ring-shaped component 16 in sliding engagement therewith. In this manner, the cord 24 can be utilized as a drawstring to collapse the inner ring-shaped component 16 within the previously open central area 12. Thus, the toroidal bathing implement 10 as illustrated in FIGS. 1 and 3–5 can be temporarily converted into a more traditional ball-shaped bathing implement as illustrated in FIG. 2. Thereafter, the inner ring-shaped component 16 can be permitted to expand about the cord 24 to return the bathing implement 10 to its normal toroid shape. A locking mechanism 42, such as a washer, clip, or the like, can be secured to the cord 24 to lock the bathing implement 10 in a ball-shape.

The novel configuration of the basic embodiment of the bathing implement 10 provides many useful and decorative features. For instance, the bathing implement 10 is easy to grip by both adults and children, can be converted into a donut or ball-shape, can be temporary worn on a bather's wrist during a bath or shower to free both hands, and can provide a flower like decoration. In the later case, a removable stick (not shown) or the like can be attached to the bathing implement 10 to resemble a stem of a flower.

As discussed below, the stretchability of the inner component of the preferred embodiment of the bathing implement 10 permits it to be secured to various shaped attachment components for a variety of purposes. For example, the attachment component can convert the bathing implement 10 into a decoration, a bath toy, a pool toy, other types of toys, or a marketing product sold in combination with soap and other related products. In addition, the attachment component can be separated from the bathing implement 10 and thereafter re-attached. Thus, the attachment component can be removed from the bathing implement 10 so that the attachment component can be used separately from the bathing implement 10, and the bathing implement 10 can be used separately from the attachment component . Thereafter, they can be re-connected for play, storage, decoration, drying or other purposes.

One contemplated example of an attachment component is a toy 26 which can embody any decorative or playful feature aesthetically pleasing to a child or other user. The toy 26 can be positioned in the open central portion 12 of the bathing implement 10 and is secured thereto by the elastic property of the inner ring-shaped component 16. Thus, the multi-use bathing implement 10 can be utilized as a water toy in a bath or pool, or it can be utilized as a non-water toy. As illustrated in FIG. 1, the illustrated toy 26 is a flower-like decoration. However, this is merely an example, and the toy 26 could be any type of toy including, for instance, a stuffed animal made from a water-friendly polyester blend that dries quickly, or it could be molded of soap. Alternatively, the toy 26 could be made of foam, polyester, PVC, terry cloth, plastic, or any other soft or rigid material and could be provided in any shape or form.

Other toys, although not illustrated, arc also contemplated for use as an attachment component. For instance, a disk, such as a frisbee or the like, could be secured within the central open portion 12 of the bathing implement 10 thereby converting the bathing implement 10 into a flying disk toy. Thus, the flying toy could be utilized to play catch, disk darts or other horseshoe-type games. The disk could be made of any rigid or soft material.

Another contemplated example of an attachment component is a bar of soap or like product. For example, a disk shaped bar of soap can be positioned within the open central portion 12 of the bathing implement 10 and retained in that position due to the elastic property of the inner ring-shaped component 16. This particular configuration provides a flower like appearance with the soap as the central portion of the flower and the sponge component 14 of the bathing implement 10 being the outwardly extending petals. This configuration also provides a ready means of applying lather to a bather with the soap attached to the bathing implement 10. Other bathing and hygiene products and shapes of soap could also be utilized with the bathing implement 10. For instance, a squeezable bladder could be located in the open central portion 12 to provide slow release of a liquid soap product.

Figure 6:
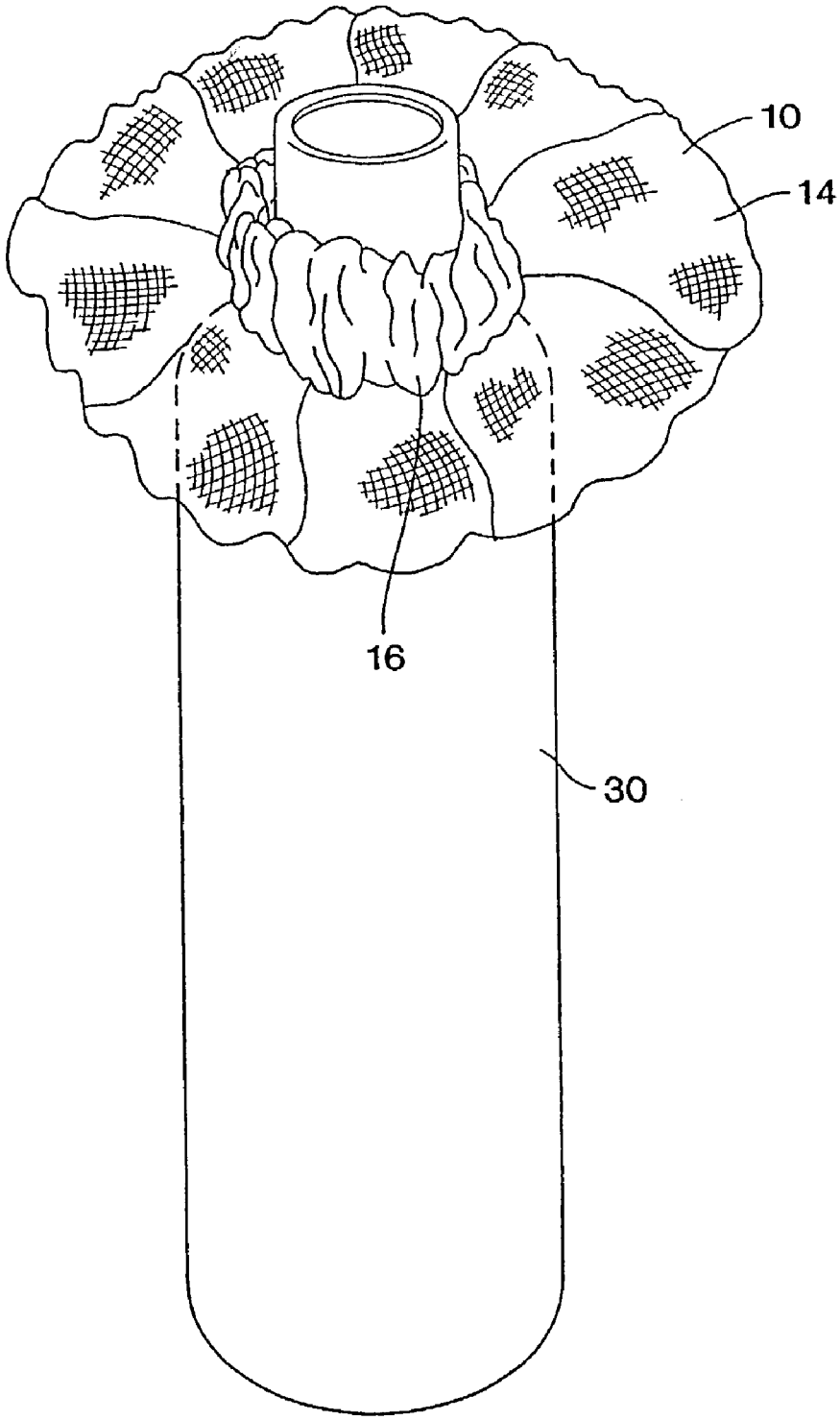
FIG 6 is a perspective view of a bathing implement according to the present invention in which the attachment component is a container.

Another complemented example of an attachment component is a container 30. The container 30 could be a bottle of liquid soap, shampoo, conditioner, spritz, hair spray, etc. as illustrated in FIG. 6. The container 30/bathing implement 10 combination provides a convenient two-for-one marketing tool for selling products in stores, and it provides a useful manner of storing a bathing implement 10 when not in use. Alternatively, the container 30 can have other configurations and can contain other products such as toys, candy, cosmetic products, dolls or the like.

A further contemplated example of an attachment component is a pocket made of netting or the like. The mesh pocket can be positioned within the bathing implement and provide a pocket for soap, soap pellets, toys, or other objects. The mesh pocket permits the free flow of water therethrough and permits ready lathering of the bather since the soap and bathing implement are provided as a single unit.

A further contemplated example of an attachment component is a cosmetic product, such as a brush or the like used in the bath area or for cleaning purposes. The bathing implement could secure around the head of the brush from which bristles extend. The head of the brush opposite the bristles can include a decoration such as objects floating within a captured liquid, a logo, or other like decorative articles. Another contemplated example of an attachment component includes a floating-type candle which can be floated in bath water during a bath.

After the attachment component is removed from the bathing implement 10, the bathing implement 10 can be attached to a person's wrist, head or hair. For example, the multi-use bathing implement 10 can be utilized as a hair holder, such as a scrunchi, or it can be worn around a person's wrist as a bracelet or wristband. In addition, the implement can be worn as a part of a costume on a person's head by wrapping it under a person's chin with the sponge component extending radially from the person's head. The bathing implement 10 can be provided in different colors, multi-colors, and textures depending on their intended purpose of use and decorative effect.

The inner ring-shaped component 16 is particularly shaped and sized to accomplish any of the above stated functions. The open central portion 12 in a non-stretched condition can be provided with any desired dimension. For example, the open central portion 12 could be sized to snugly fit about the average size of a person's wrist. Larger or smaller dimensions can also be utilized depending on the size of the attachment component utilized therewith and its intended function. For example, small sized central portions 12 can be provided such that only a finger or two can fit within the central portion 12 to provide greater control for manipulating a sponge against the face of bather or other body location. The width "W" and thickness "T" of the inner ring-shaped component 16 can be provided as desired. Preferably, these dimensions are provided such that the bathing implement 10 can be readily grasped and controlled. However, more or less width and thickness can be provided depending on the specific use and desired function. The thickness "T" can be, for instance, about a half an inch, while the width "W" can be about one to about three inches wide. These dimensions are merely provided as examples, and the bathing implement 10 according to the present invention can be provided in any desired size.

One contemplated alternate embodiment of the present invention, is to provide an ergonomic grip portion on the inner component 16 of the bathing implement. To this end, the inner component 16 could be made of a rigid or semi rigid material in which a part thereof provides projections and recesses for defining finger engaging surfaces on the inner component 16. In this embodiment, the inner component can be, elastic, inelastic, or just a portion of the component can be made of an elastic material.

Another contemplated embodiment is to integrally attach a second sponge component (not shown) to the inner peripheral wall of the inner ring-shaped component 16 so that the second component extends radially inward relative to the inner ring-component 16. Alternatively, a strip of VELCRO hook and loop fasteners or the like could be integrally attached to the inner peripheral wall of the inner ring-shaped component 16 to enable a secure attachment of the bathing implement 10 to an attachment device.

The size, configuration and texture of the sponge component 14 can vary. For instance, the outermost edge 34 of the sponge component 14 can provide a circular periphery as illustrated, or it could provide a non-circular periphery, such as one that undulates. The sponge component 14 can be provided of different stretchable or non-stretchable intertwined materials to provide a different surface texture for different uses. For instance, some parts of the bathing implement may provide a soft washing surface for use on tender skin, while other parts of the same bathing implement may provide a rougher surface for washing less tender skin. The sponge component 14 can also be provided in different intertwined colors to provide a decorative effect. As illustrated, the sponge component 14 radially extends about two inches from the inner ring-shaped component 360° thereabout. However, the dimensions of the sponge component 14 can be made as large or as small as desired.

Thus, the bathing implement 10 according to the present invention provides a combination bathing sponge and removable toy, soap, novelty, or other product. The toy, soap or other product can be readily removed from the bathing implement 10. If a toy is utilized, it can be tossed or floated on a surface of water, submerged and allowed to pop up out of the water, or played with outside of a water area. The removable component can be provided with an appearance which is particularly appealing to the specific bather, or a standard container/bottle of body wash, spritz, shampoo, etc. The bathing implement can be used with or without an attached soap product to wash and exfoliate the skin of the bather. The sponge is abrasive enough to dislodge dirt and grime from the body of the bather, yet at the same time, is soft enough to be used on sensitive skin.

The inner ring-shaped component 16 can be used as an attachment mechanism for the toy, soap or other attachment component, or as a handle for use in manipulating the bathing implement. Further, the size of the inner ring-shaped component 16 can be adjustable to fit around a knob or the like in a shower for drying purposes. For example, FIGS. 8–15 illustrate knob-shaped hanging devices 44, 46, 48, 50, 52, 54 and 56 contemplated for use with the bathing implement 10.

Figure 8:
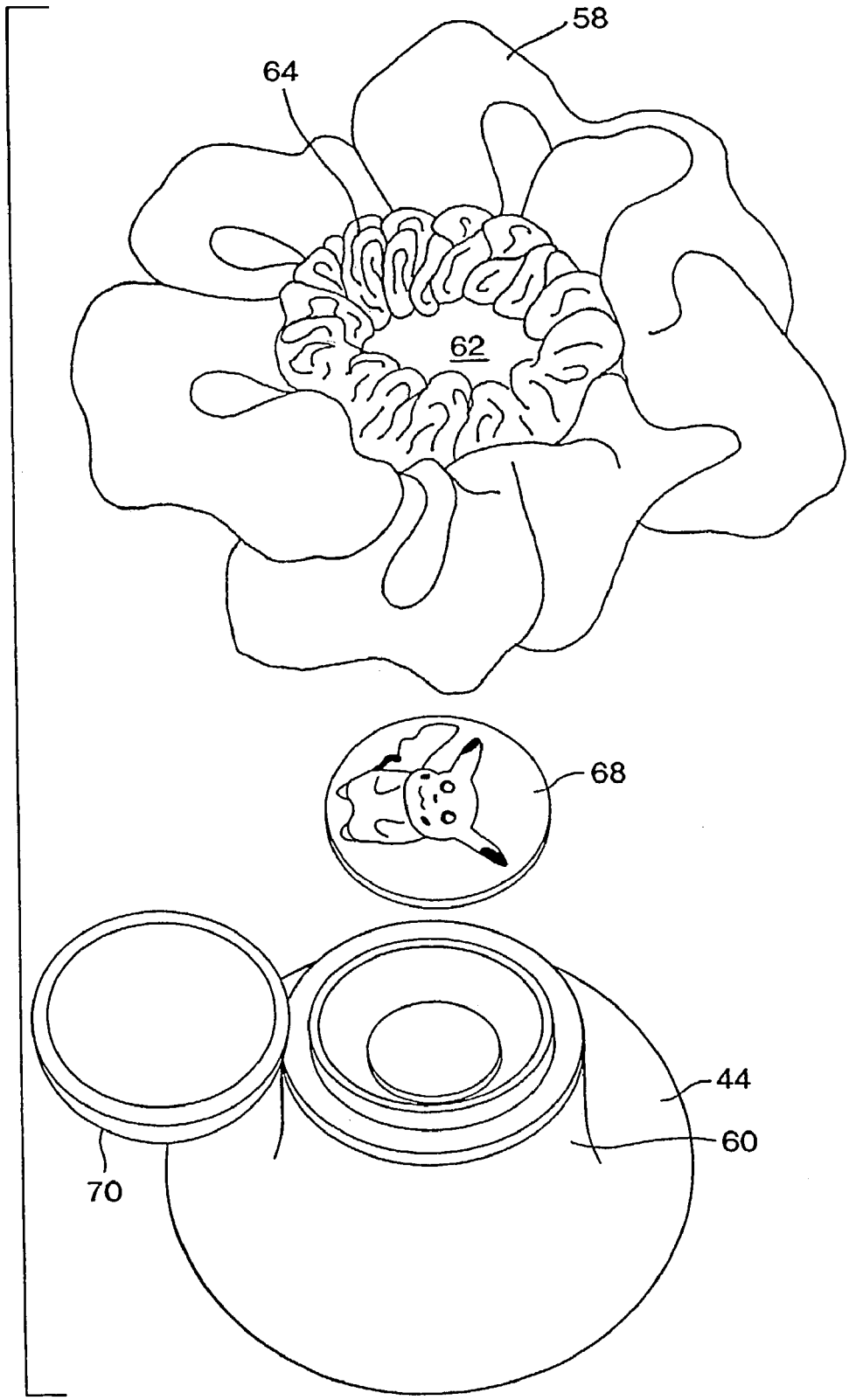
FIG. 8 is an exploded view of a combination bathing implement and hanger therefor according to the present invention.

FIG. 8 discloses a banging device 44 which has a knob-like shape and which can be utilized to hold a bathing implement 58 according to the present invention. To this end, the forward extending knob 60 of the device 44 is adapted to extend through the central opening 62 of the bathing implement 58 whereby the inner loop component 64 of the bathing implement snugly fits around the knob 60 and holds the bathing implement 58 to the hanging device 44. Preferably, the hanging device 44 has a rearward extending suction cup 66 (see FIG. 12) utilized to removably connect the hanging device 44 to a wall or like surface. For example, the hanging device 44 could be secured to a shower wall so that the bathing implement 58 can be stored and dried in a readily accessible location in a shower/tub. Alternatively, the hanging device 44 could be secured to a sink, wall, window or like surface in a kitchen for holding a kitchen cleaning implement, for instance a toroid-shaped cleaning implement made of copper wool, a sponge material, a mesh material or the like. For examples, see kitchen cleaning implements 92*a*, 92*b*, 92*c* and 92*d* illustrated in FIGS. 18–21.

Figure 12:
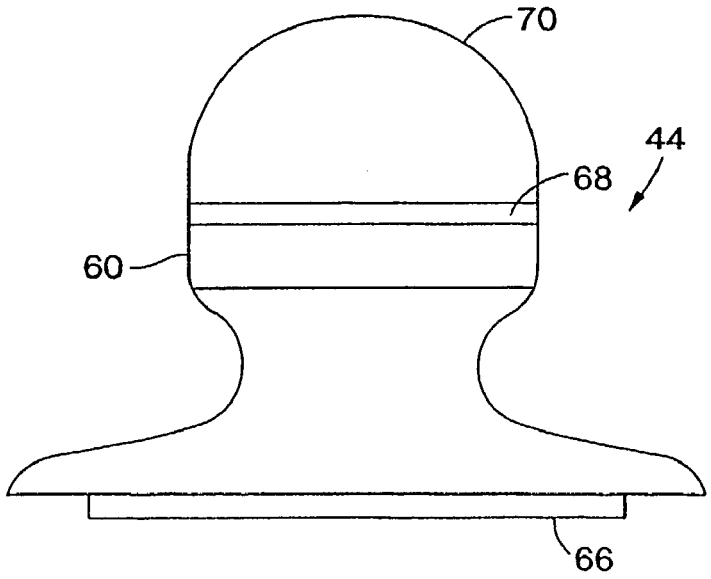
FIG. 12 is a top plan view of the hanger illustrated in FIG. 8.

As illustrated in FIG. 8, a decoration, toy or like item 68 can be provided in a front portion 70 of the knob 60. To this end, the front portion 70 can be opened as illustrated in FIG. 8 to remove or replace the item 68, or closed as illustrated in FIG. 12 to display or store the item 68. Preferably, the front portion 70 is made of a clear plastic material so that the item 68 or like decoration, design or logo is visible and can be readily and clearly viewed.

Figure 9:
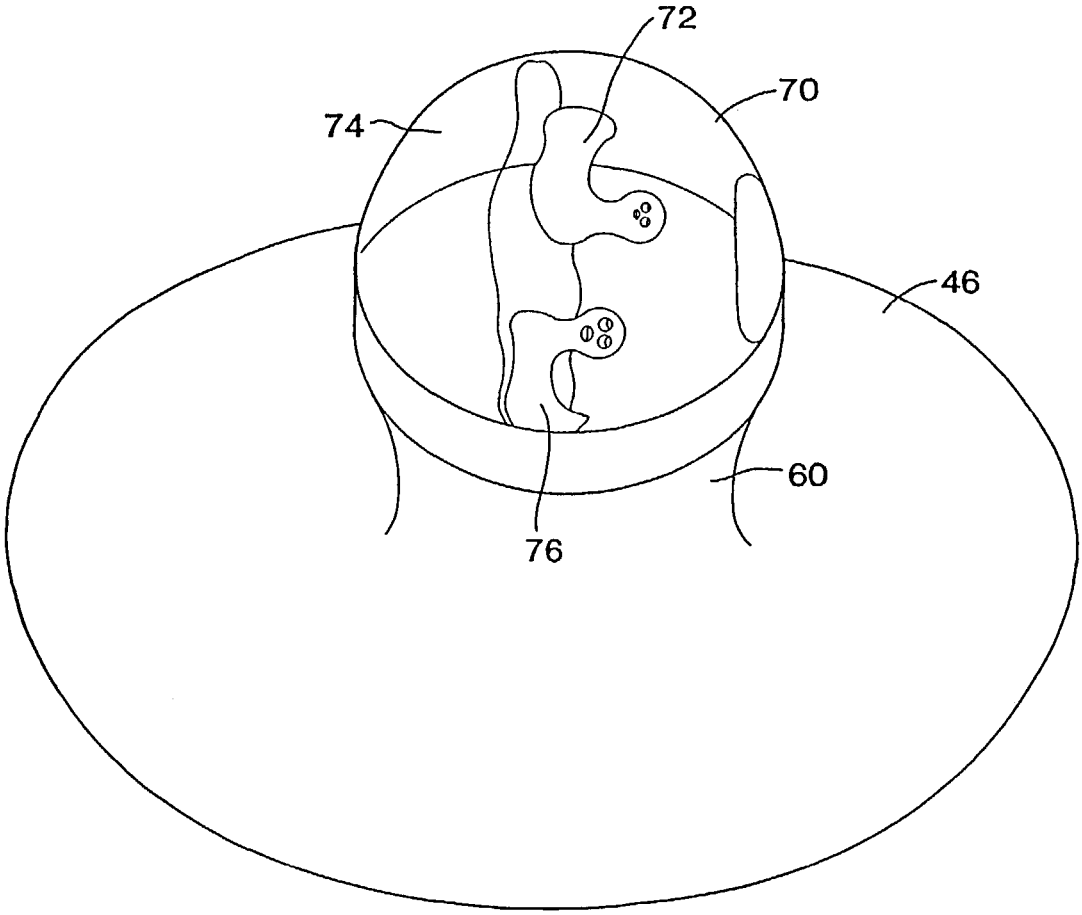
FIG. 9 is a perspective view of a second embodiment of a hanger for a bathing implement.
Figure 10:
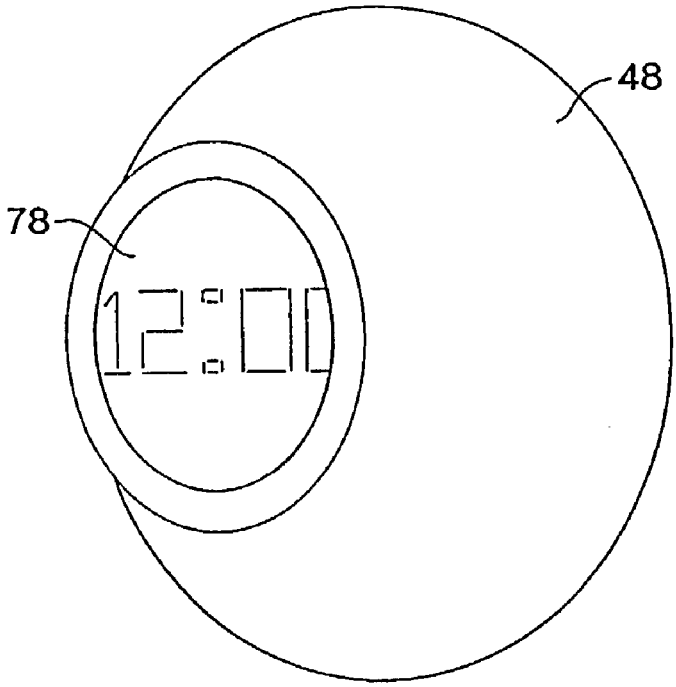
FIG. 10 is a perspective view of a third embodiment of a hanger for a bathing implement.
Figure 11:
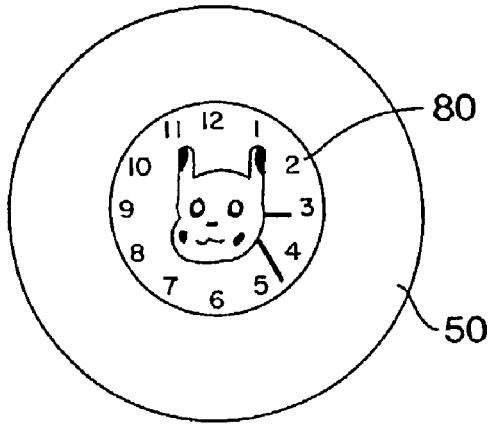
FIG. 11 is a front elevational view of a fourth embodiment of a hanger for a bathing implement.
Figure 13:
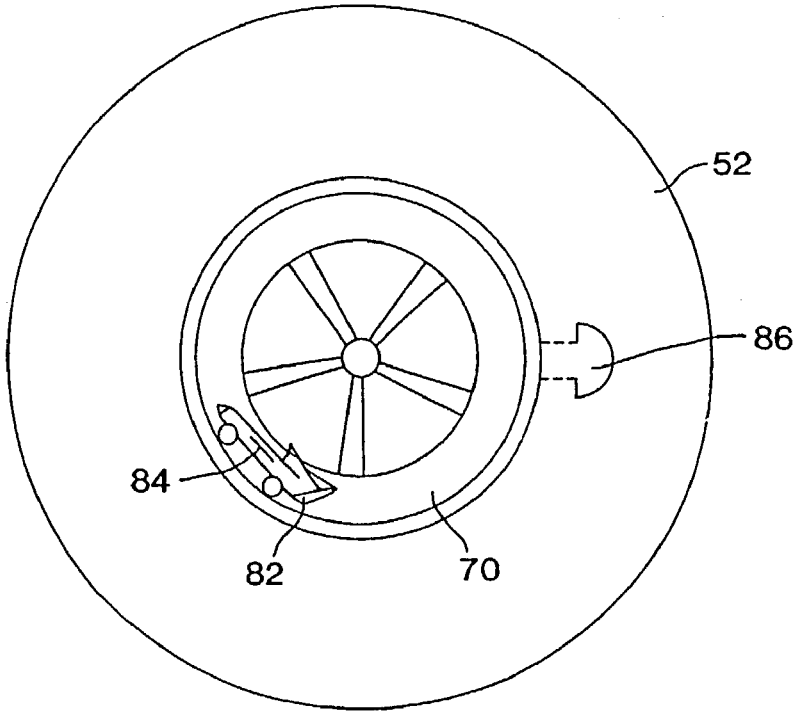
FIG. 13 is a front elevational view of a fifth embodiment of a hanger for a bathing implement.
Figure 15:
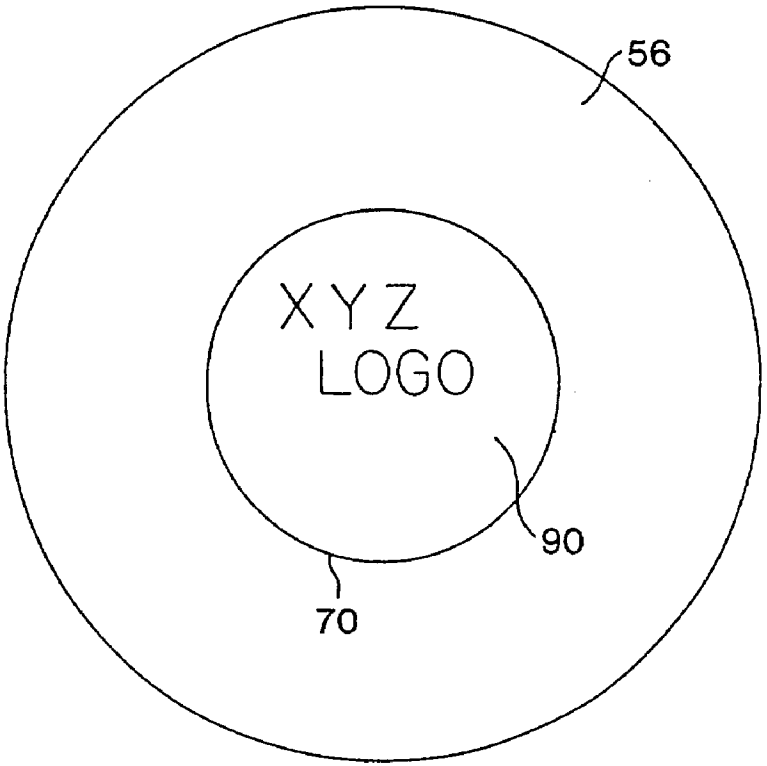
FIG. 15 is a front elevational view of a seventh embodiment of a hanger for a bathing implement.
Figure 14:
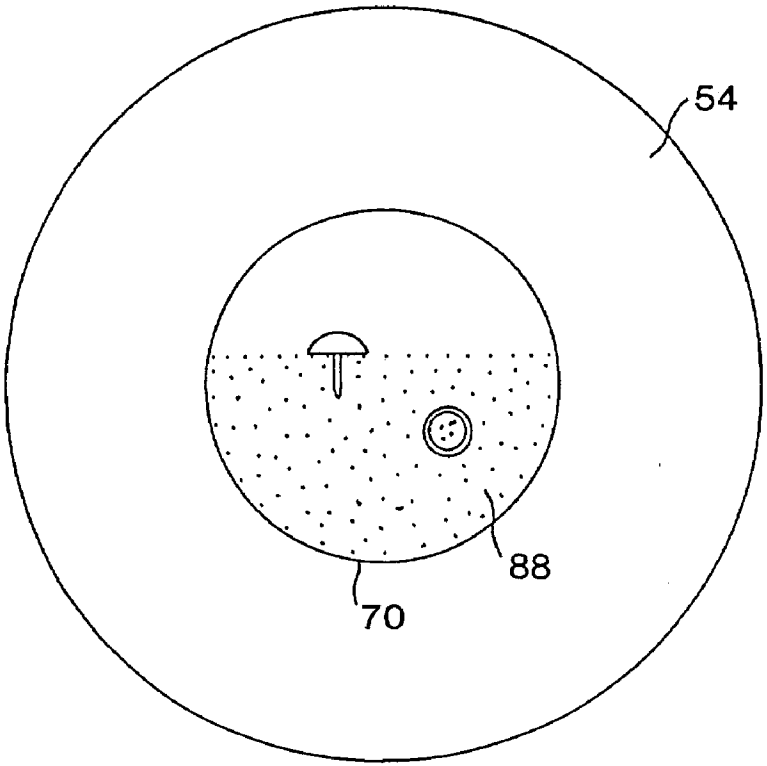
FIG. 14 is a front elevational view of a sixth embodiment of a hanger for a bathing implement.

An alternate hanging device 46 is illustrated in FIG. 9. In this embodiment, the front portion 70 retains a decoration 72 consisting of captured water-oil mixture 74 in which toy ducks 76 are located. Other alternate embodiments shown as hanging devices 48 and 50 in FIGS. 10 and 11 include clocks 78 and 80, respectively. In FIG. 13, a hanging device 52 is shown having a movable mechanism 82 in the front portion 70 which consists of a toy automobile 84 which spins around the front portion 70 when a button, lever or the like 86 is pressed, pulled or otherwise activated. In FIG. 14, the hanging device 54 has a front portion 70 which is rotatable in a clockwise and/or counter-clockwise direction and which contains sand and other objects 88 that change position upon rotation of the front portion. FIG. 15 shows a hanging device 56 which displays a logo or like decoration 90.

Of course, the hanging devices of the present invention can also include other articles and products, for instance, they can contain a dispensable liquid soap, shampoo, conditioner, hand or face cream or the like, or they can contain soap, bath or salt pellets or the like. In addition, the front portion of the knob can be structured to pivot along a vertical or horizontal axis so that a three-dimensional decoration can be provided, displayed and altered on the front portion upon pivoting the front portion. For instance, the three-dimensional display could be a hologram, lenticular lens, or the like which changes depending on the viewing angle of the display. Further, the hanging devices could be utilized to hang articles other than cleaning implements, for instance, personal care products, hair fashion articles, jewelry and the like.

With respect to the above described cleaning implements, hanging devices and other attachment articles, children can have their own personalized toy bathing implements for use during bath time which will create in the children a greater awareness of cleanliness and of the need to throughly wash their bodies. Still further, the invention is not limited to use by children; rather, different sized and shaped implements and attachments can be used to accommodate adults. Finally, the inner component 16 can be made of mesh netting to provide an all mesh netting sponge which would be capable of quick drying.

The disclosed implement 10 can also be utilized as a cleaning implement for cleaning kitchen surfaces, bathroom surfaces, pots and pans, sinks, and other similar surfaces and articles. The open central area 12 permits ready grasping of the implement 10 during cleaning and can receive a bottle/container of cleaning liquid, gel or powder sold in combination with the implement. This provides an efficiently packaged cleaning product and applicator combination. The above described suction cup hanging devices can also be utilized in the kitchen or other environment.

The disclosed implement 10 can also be utilized as a cleaning implement for cleaning kitchen surfaces, bathroom surfaces, pots and pans, sinks, and other similar surfaces and articles. The open central area 12 permits ready grasping of the implement 10 during cleaning and can receive a bottle/container of cleaning liquid, gel or powder sold in combination with the implement. This provides an efficiently packaged cleaning product and applicator combination. The above described suction cup hanging devices can also be utilized in the kitchen environment While preferred multi-use bathing implements have been described in detail, various modifications, alterations, and changes may be made without departing from the spirit and scope of the present invention as defined in the appended claims.

The invention claimed is:

1. A multi-use washing implement, comprising:

an inner loop component having an outer peripheral surface and defining a central opening;

an outer component concentrically disposed about said inner loop component and attached to said inner loop component so that said outer component extends radially outward from said inner loop component and provides the washing implement with a substantially toroid shape; and an implement hanging device, said device including a rearwardly extending suction cup and a forward extending knob, wherein said forward extending knob fits within said central opening defined by said inner loop component for purposes of removably securing said multi-use washing implement to said implement hanging device.

2. A multi-use washing implement according to claim 1, wherein said inner loop component has an elastic property and includes an inner elastic ring-shaped band covered by an outer layer of water friendly material.

3. A multi-use washing implement according to claim 2, wherein said outer component is a sponge component.

4. A multi-use washing implement according to claim 2, wherein said outer component is made of elastomeric fibers.

5. A multi-use washing implement according to claim 2, wherein said outer layer of said inner loop component is selected from the group consisting of taffeta, materials that dry quickly, stretchable materials, and terry cloth.

6. A multi-use washing implement according to claim 2, wherein said outer component is a mesh netting type of material for use in applying lather to cleanse a bather.

7. A multi-use washing implement according to claim 1, wherein said inner loop component has an ergonomic gripping surface thereon which includes projections and recesses.

8. A multi-use washing implement according to claim 1, wherein said inner loop component is molded of a plastic rubberized material.

9. A multi-use washing implement according to claim 1, wherein said knob has a front portion for holding and displaying an item selected from the group consisting of a toy, a logo, a design, a clock, a novelty item, a decoration, a bathing product and a cosmetic product.

10. A combination cleaning implement and support device, comprising:

a cleaning implement having an open channel extending therethrough;

a support device having a base with a forward projecting knob on which said cleaning implement is removably supported such that said knob engages said cleaning implement within said open channel; and a suction cup extending rearwardly from said base for removably securing said base to a pre-existing surface to hang said cleaning implement;

said cleaning implement having an inner loop component which defines said open channel and a sponge component concentrically disposed about said inner loop component, said sponge component extends radially outward from said inner loop component and provides the cleaning implement with a substantially toroid shape.

11. A combination cleaning implement and support device according to claim 10, wherein said sponge component has at least one of a soft washing surface and a coarse washing surface.

12. A combination cleaning implement and support device according to claim 10, wherein said knob has a front portion for holding and displaying an item selected from the group consisting of a toy, a logo, a design, a clock, a novelty item, a decoration, a bathing product and a cosmetic product.

13. A combination cleaning implement and support device according to claim 12, wherein said item is a toy which has moving parts which can be activated.

14. A combination cleaning implement and support device according to claim 12, wherein said front portion of said knob is capable of opening and closing such that said item is removable from said support device.

* * * * *